US005879227A

United States Patent [19]

Martin et al.

[11] Patent Number: 5,879,227

[45] Date of Patent: Mar. 9, 1999

[54] SANDER WITH MULTIPLE-LAYERED PLATEN

[75] Inventors: Michael Martin, Darlington; Eric Cockburn, Spennymoor, both of United Kingdom

[73] Assignee: Black & Decker Inc., Newark, Del.

[21] Appl. No.: 90,462

[22] Filed: Jun. 4, 1998

Related U.S. Application Data

[63] Continuation of Ser. No. 725,365, Oct. 3, 1996.

[30] Foreign Application Priority Data

Oct. 4, 1995 [GB] United Kingdom ..... 9520255

[51] Int. Cl.[6] ..... B24B 23/00

[52] U.S. Cl. ..... 451/356; 451/354; 451/490; 451/521; 451/529

[58] Field of Search ..... 451/344, 350, 451/351, 354, 356, 357, 490, 491, 495, 521, 527, 529

[56] References Cited

U.S. PATENT DOCUMENTS

| | | | |
|---|---|---|---|
| 1,165,452 | 12/1915 | Rudolph | 451/495 |
| 1,635,350 | 7/1927 | Simons | 451/527 |
| 2,435,335 | 2/1948 | Andrews | 451/495 X |
| 4,571,893 | 2/1986 | Braasch | 451/529 |
| 5,054,245 | 10/1991 | Coty | 451/495 X |

*Primary Examiner*—Timothy V. Eley

*Attorney, Agent, or Firm*—Bruce S. Shapiro; Dennis A. Dearing; John D. Del Ponti

[57] ABSTRACT

A sanding apparatus (1) has a sanding platen (2) to which motion is applied. The platen (2) has a flat surface (9) to which an abrasive sheet (22) is applied. The peripheral edge (3) of the platen (2) has a point (4) which can be used for detailed sanding. The surface (9) has a detachable portion (14) adjacent the point (4). The detachable portion (14) can be removed from the remainder of the platen (2) and rotated through 180°. The abrasive sheet (22) can have an area corresponding to the detachable portion (14) of the surface (9) which is removable from the remainder of the abrasive sheet (22) by means of a perforated line (24).

13 Claims, 2 Drawing Sheets

SANDER WITH MULTIPLE-LAYERED PLATEN

This application is a continuation of application Ser. No. 08/725,365 filed Oct. 3, 1996. (pending).

This invention relates to a sanding apparatus, particularly a sander with multiple-layered platen with a detail sanding point.

BACKGROUND OF THE INVENTION

Sander with multiple-layered platen are known which have platens with a body on which is mounted a foam pad which has a surface to which abrasive sanding sheets are attached. An orbital or random motion is applied to the platen by a central drive from a motor. The platen moves in relation to a head of the apparatus. The platen body and the foam pad can be held against the surface to be sanded and the motion applied to the platen results in a sanding of the surface.

A carrier layer can be disposed between the platen body, which is generally formed of a hard plastics material, and the foam pad. The foam pad can be attached to the carrier layer by means of a Velcro (registered trade mark) attachment means. The term platen is used herein to denote the combination of the platen body and foam pad and any intermediate layer.

The platens can be of varying shapes, known examples include circular and rectangular platens. Sanding apparatus suitable for detailed sanding have platens which are generally triangular in shape with outwardly curved edges. Iron shaped platens have also been developed in which a single point tip is provided for accessing corners and providing detailed sanding whilst a large surface is provided for general flat sanding.

Sanding platens with pointed tips often result in the tip of the foam pad becoming worn due to the sanding platen being used at an angle and thereby wearing the foam at the tip of the foam pad.

SUMMARY OF THE INVENTION

According to the present invention there is provided a sanding apparatus comprising a platen to which motion is applied, the platen having a surface to which an abrasive sheet can be applied, the peripheral edge of the platen having a point, wherein the surface has a portion adjacent the point which is detachable from the remainder of the platen.

Preferably, the platen is formed of a base layer, a carrier layer and a surface layer. The surface layer may be formed of a foam material.

Preferably, the detachable portion is in the shape of a parallelogram with two adjacent sides of the parallelogram forming the point of the peripheral edge of the platen. Most preferably, the parallelogram has equal sides. The sides of the parallelogram may be slightly curved outwardly.

The detachable portion may be attached to the platen by means of a nut and bolt attachment. Alternatively, the detachable portion may be attached to the platen by Velcro attachment means.

Preferably, the detachable portion can be rotated through 180° such that the point at the peripheral edge of the platen is changed.

An abrasive sheet can be attached to the surface by means of a Velcro attachment means. Preferably, the abrasive sleet has a corresponding detachable portion which is defined by a perforated line.

BRIEF DESCRIPTION OF THE DRAWINGS

A preferred embodiment of a sanding apparatus in accordance with the present invention is now described by means of example only, with reference to the accompanying drawings, in which.

DETAILED DESCRIPTION OF THE PREFERRED EMBODIMENT

Figure 1:
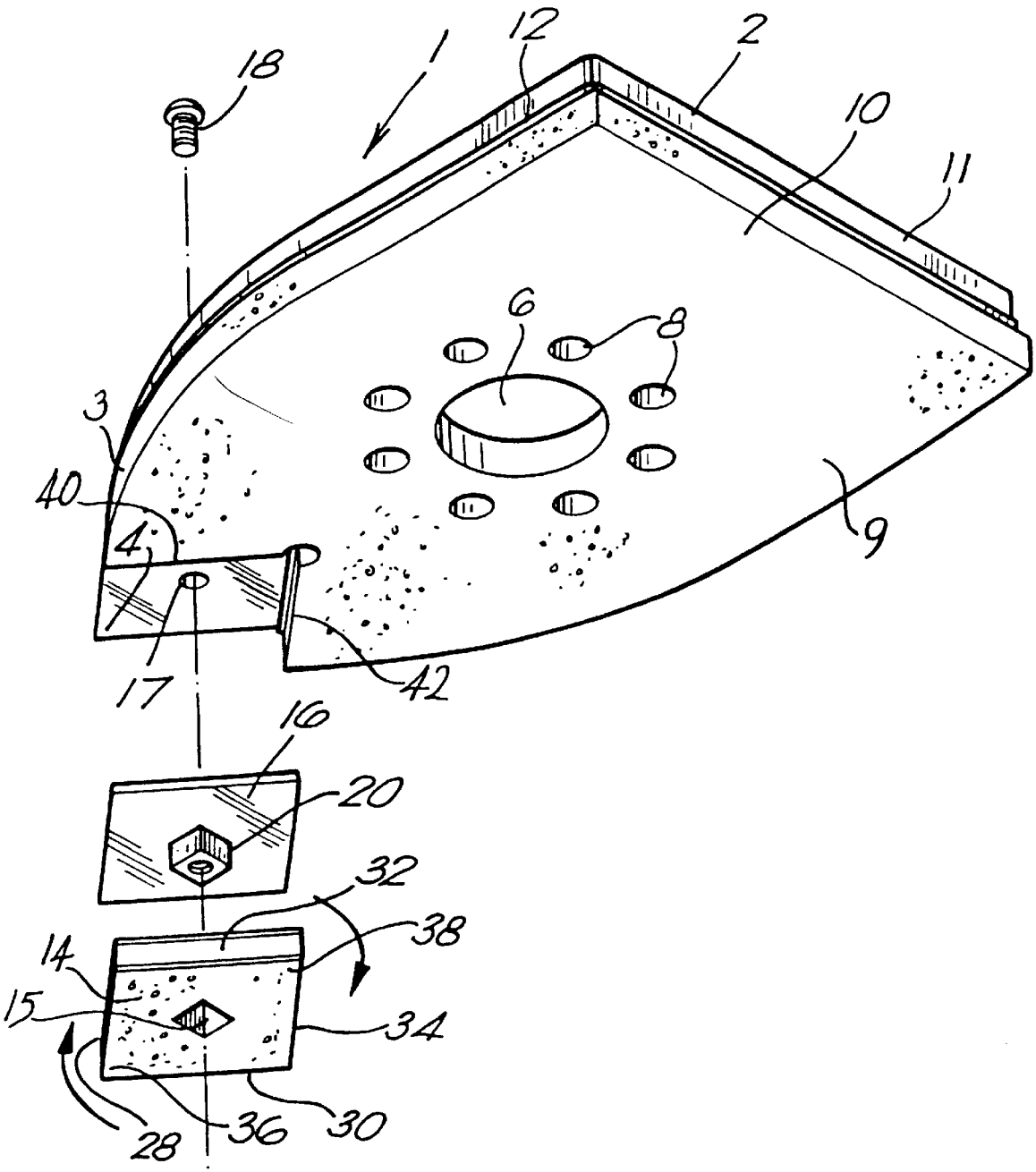
FIG. 1 is an exploded perspective view of the sanding apparatus.
Figure 2:
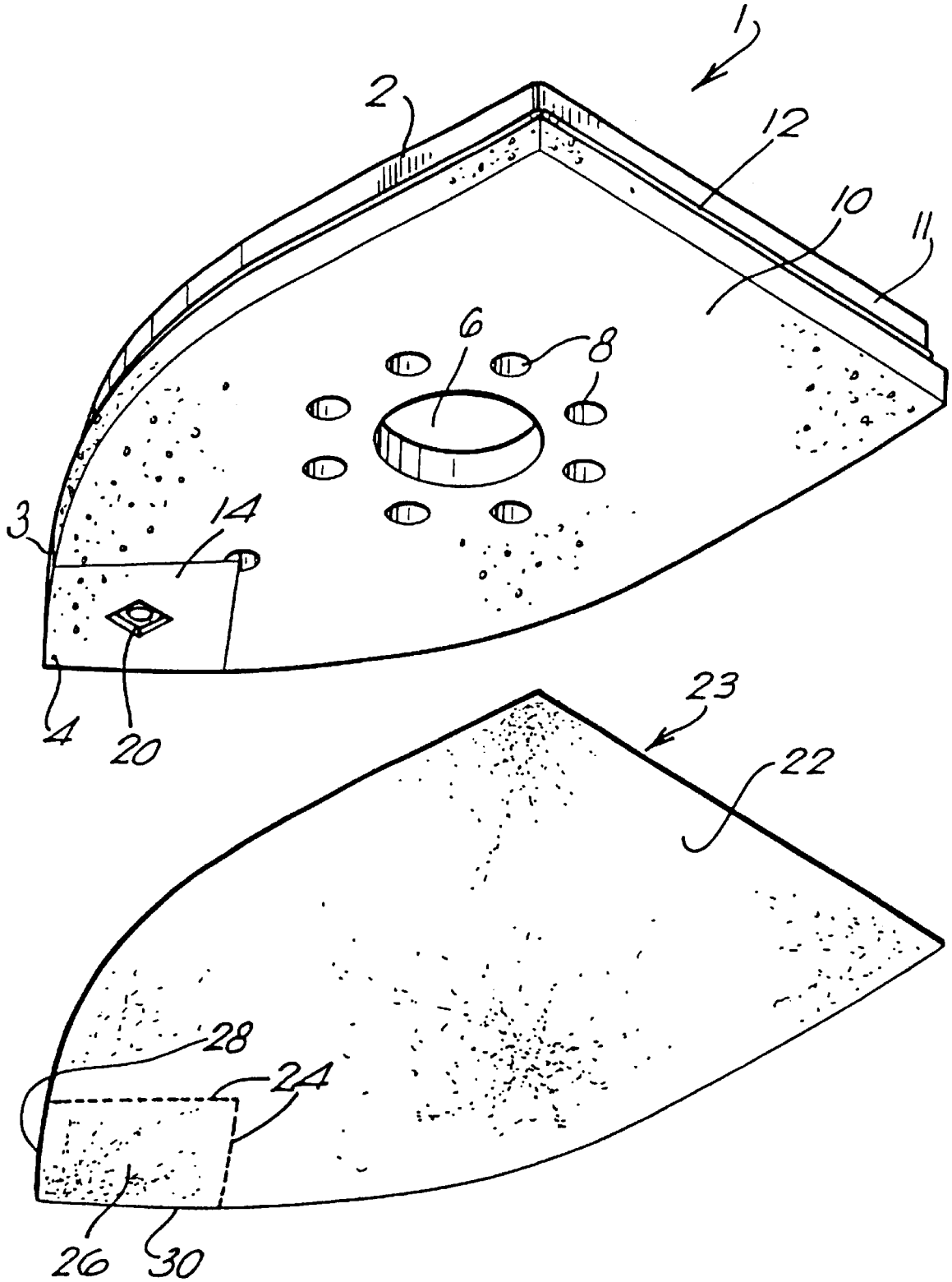
FIG. 2 is a perspective view of the assembled sanding apparatus of FIG. 1 with an abrasive sheet shown separately.

Referring to the drawings, a sanding apparatus 1, or sander assembly, has a platen 2 with a base layer 11, a carrier layer 12 and a foam surface layer 10. The sanding platen 2 has a peripheral edge 3 with a point 4 forming an iron-shape surface 9 of the platen 2. The point 4 is used for sanding corners and other detailed areas.

Motion is applied to the sanding platen 2 by a motor through a central drive 6. Location holes 8 restrict the motion of the sanding platen 2 to a random, non-rotating motion.

An abrasive sheet 22 is applied to the surface 9 of the surface layer 10. The abrasive sheet 22 can be attached to the surface 9 by means of a Velcro attachment. A Velcro attachment enables the abrasive sheet 22 to be applied to an irregular shape of surface 9. The underside 23 of the abrasive sheet 22 has a first Velcro surface which is attachable to a second Velcro surface provided on the surface 9 of the surface layer 10.

A portion 14 of the foam surface layer 10 adjacent to the detail point 4 of the peripheral edge 3 is detachable from the remainder of the sanding platen 2. The detachable portion 14 can be loosened or completely detached from the sanding platen 2 and rotated through 180°, or even replaced, as the edges 28, 30 on either side of the point 4 become worn.

The detachable portion 14 is an equal sided parallelogram with two first sides 28, 30 which form an acute angle 36 at the point 4. Second sides 32, 34 form the opposing acute angle 38. The two edges 40, 42 of the remaining portion of the foam surface layer 10 of the sanding platen 2, which correspond to the second edges 32, 34 of the detachable portion 14, form a corresponding acute angle on the surface 9.

The two angled sides 40, 42 of the remaining portion of the foam surface layer 10 provide a wedge which prevents excessive movement of the detachable portion 14 during the sanding movement of the platen 2.

The detachable portion 14 can be attached to the sanding platen 2 by an attachment means in the form of a nut 20 and bolt 18. The bolt 18 is inserted through the sanding platen 2 from the opposite side to the surface 9. The bolt 18 passes through a hole 17 in the base layer 11 of the sanding platen 2. The bolt 18 also passes through a portion 16 of the carrier layer 12 and a nut 20 is provided on the far side of this layer 12. The detachable portion 14 of the foam surface layer 10 is attached to the carrier portion 16. The detachable portion 14 of the foam surface layer 10 has a recess 15 in which the nut 20 is contained.

In use, an abrasive sheet 22 is applied to the surface 9 of the sanding platen 2, the motor can be started and the sanding operation commenced. During sanding, the platen 2 is often tilted with excessive sanding taking place at the point 4. The point 4 of the foam surface layer 10 of the sanding platen 2 therefore becomes worn. The detachable portion 14 can be detached from the sanding platen 2, after first breaking the perforated line 24 on the abrasive sheet 22. The detachable portion 14 can be rotated through 180° thereby providing a new unworn point. The detachable portion 14 is reattached to the sanding platen 2 and sanding can be recommenced.

As an alternative to the bolt attachment means, the detachable portion 14 can be attached to the sanding platen by Velcro attachment means. In such an embodiment, the wedge shape of the sides 40, 42 which prevents movement of the detachable portion 14 is beneficial.

The components of the detachable portion 14 can be replaced as these become worn, providing a longer life for the sanding apparatus.

Modifications and improvements can be made to the above without departing from the scope of the present invention.

It is claimed:

1. A sander with a multiple-layered platen, which comprises:

a platen assembly to which motion can be applied;

the platen assembly having a first surface located in a given plane which is structured to attach to a single prescribed sheet of material in the given plane upon interfacing engagement therewith in the given plane;

the platen assembly having a second surface located in the given plane in juxtaposition with, and independent of, the first surface;

the second surface structured to attach to the single prescribed sheet of material in the given plane upon interfacing engagement therewith in the given plane; and the second surface being detachable from assembly with the platen assembly independently of the first surface.

2. A sander as claimed in claim 1, which further comprises:

means for detachably securing the second surface with the platen assembly independently of the first surface.

3. A sander assembly, which comprises:

a platen assembly to which motion can be applied;

the platen assembly having a first surface in a given plane which is structured to attach to a single prescribed sheet of material in the given plane upon interfacing engagement therewith in the given plane ;

the platen assembly having a detachable second surface located in the given plane in juxtaposition with and independently of the first surface, the second surface being structured to attach to the single prescribed sheet of material in the given plane upon interfacing engagement therewith in the given plane; and a detachable fastening structure assembled with the platen assembly and the second surface for detachably securing the second surface with the platen assembly in juxtaposition with and independently of the first surface.

4. A sander as claimed in claim 3, wherein the platen assembly is formed with a base layer, a carrier layer and a surface layer.

5. A sander as claimed in claim 4, wherein the surface layer is formed of a foam material.

6. A sander as claimed in claim 4, wherein the surface layer includes the first surface and the second surface.

7. A sander as claimed in claim 3, wherein the detachable second surface is in the shape of a parallelogram with two adjacent sides of the parallelogram forming a point of a peripheral edge of the platen assembly.

8. A sander as claimed in claim 7, wherein the parallelogram has equal sides.

9. A sander as claimed in claim 7, wherein the sides of the parallelogram are slightly curved outwardly.

10. A sander as claimed in claim 3, wherein the detachable second surface may be attached to the platen assembly by means of a nut and bolt attachment.

11. A sander as claimed in claim 3, wherein the detachable second surface is attached to the platen assembly by Velcro attachment means.

12. A sander as claimed in claim 3, wherein the detachable second surface can be rotated through 180° independently of the first surface such that a point of a peripheral edge of the second surface is changed.

13. A sander as claimed in claim 3, which further comprises a Velcro attachment means for attaching the prescribed sheet material to the first and second surfaces.

* * * * *